United States Patent [19]

Skelly

[11] Patent Number: 4,610,139

[45] Date of Patent: Sep. 9, 1986

[54] HYDRAULIC SPEED CONTROL AND BRAKING APPARATUS FOR DRAW WORKS

[76] Inventor: Michael Skelly, P.O. Box 2687, Pampa, Tex. 79066-2687

[21] Appl. No.: 693,768

[22] Filed: Jan. 23, 1985

[51] Int. Cl.[4] ..... F15B 15/00

[52] U.S. Cl. ..... 60/327; 60/486

[58] Field of Search ..... 60/327, 435, 486

[56] References Cited

U.S. PATENT DOCUMENTS 4,219,049 8/1980 Skelly ..... 137/625.46 X
4,330,008 5/1982 Skelly ..... 137/596.13
4,448,215 5/1984 Skelly .

*Primary Examiner*—Gerald A. Michalsky

*Attorney, Agent, or Firm*—Thomas L. Cantrell; Stanley R. Moore

[57] ABSTRACT

A winch apparatus, such as draw works used for raising and lowering drill pipe into a borehole, in which motive power is provided by a hydraulic motor. A multi-stage rotary disk valve is interposed between the fluid supply pump and the hydraulic motor to provide a variable fluid flow rate and thereby to provide means for variably controlling the speed and direction of rotation of the draw works. A directional control disk is provided in the valve to provide reverse flow to prevent cavitation when the drill pipe is in free fall into the borehole, which drives the hydraulic motor in reverse. The directional control disk also controls the entry into the reverse flow of additional fluid provided by a high volume, low pressure auxiliary pump.

15 Claims, 2 Drawing Figures

HYDRAULIC SPEED CONTROL AND BRAKING APPARATUS FOR DRAW WORKS

BACKGROUND OF THE INVENTION

The invention relates to new and useful improvements in draw works use in a drilling rig.

There are many situations in which it is desirable to drive a rotating object with a hydraulic apparatus, and further to provide a braking force to the object without the use of friction braking. An example is draw works used in the oil and gas drilling industry for raising and lowering drill pipe into a borehole during drilling or workover operations.

The draw works on a drilling rig consists of a powerful winch having a large drum for storing cable. The cable is interconnected to the drill pipe support mechanism by means of a travelling block, and rotation of the drum raises and lowers the travelling block, and thus the drill pipe string. When the drill string is being raised, the draw works supports the full weight of the drill string until the slips are engaged to support the string while a section of pipe is being removed. When the drill string is being lowered, the winch is allowed to freewheel as the drill string is dropped under the force of gravity. When a sufficient length of the drill string is thus inserted into the borehole, a brake is applied to stop the fall.

In the present practice the draw works is usually powered by an internal combustion engine or an electic motor, and the braking is a sequential operation using two different types of braking mechanisms. Although the typical draw works has a friction brake consisting of a metal band about a drum, it is not initially used since the momentum of the dropping drill string would quickly wear it out. Instead a water brake, consisting of a paddle wheel in a volume of fluid, is used to dampen, and thus slow, the fall of the drill string. Only when the drill string has been slowed sufficiently by the water brake is the band brake engaged to apply the final braking force.

It is therefore an object of the present invention to provide a draw works, or similar winch device, driven by a hydraulic mechanism.

It is another object of the present invention to provide a draw works, or other similar winch device, having an easily operable speed control.

It is a further object of the present invention to provide a draw works, or other similar winch device, in which the motive mechanism is also used for braking.

It is a yet another object of the present invention to provide a hydraulically operated draw works, or other similar winch device, whose motor also acts as a water brake.

It is still another object of the present invention to provide a hydraulic draw works, or other similar winch device, having a hydraulic braking mechanism which is not subject to cavitation.

SUMMARY OF THE INVENTION

With these and other objects in view, the present invention uses a a hydraulic motor to drive the draw works and thereby raise the drill string. The motor is driven by a first stream of hydraulic fluid when the drill string is being raised, but is is allowed to freewheel in the reverse direction when the drill string is being lowered into the borehole. When braking is desired, the flow of the first stream of fluid is reversed, and a second stream of fluid is combined with the first and provided to the motor in the reverse direction. The combination of flow reversal and the second stream of fluid acts to brake the draw works through a dashpot action in the motor, and the increased pressure provided by such combination prevents cavitation in the motor.

BRIEF DESCRIPTION OF THE DRAWINGS

The invention may be more fully understood by reading the following description of a preferred embodiment of the invention in conjunction with the appended drawings wherein.

DETAILED DESCRIPTION OF A PREFERRED EMBODIMENT

Figures 1, 2:
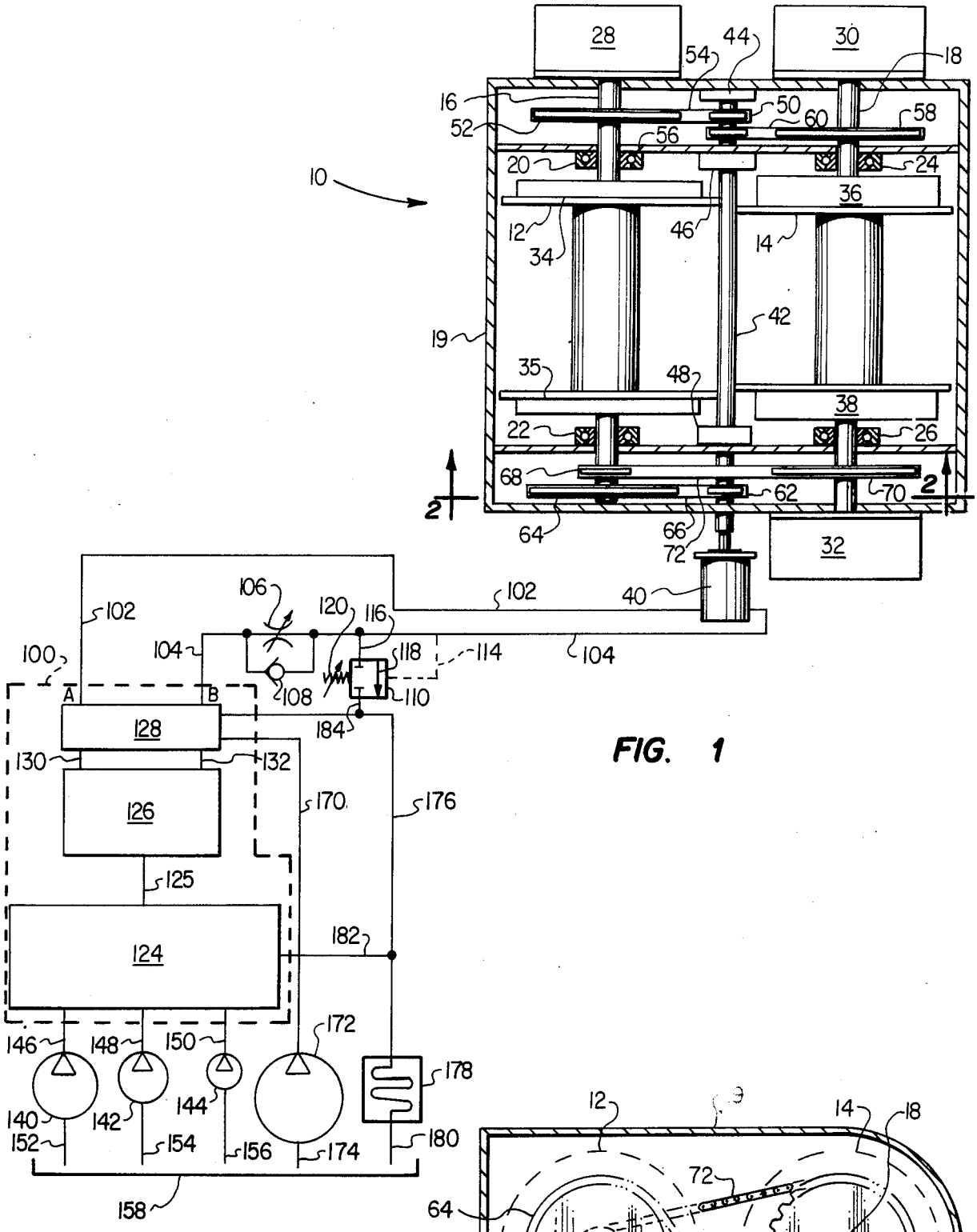
FIG. 1 is a combined plan view of a draw works and a somewhat schematic view of the associated hydraulic supply and control system.
FIG. 2 is is a sectional front view of the draw works of FIG. 1 taken along section line 2—2.

In FIGS. 1 and 2, a workover or drilling rig draw works 10 of generally conventional design has a sand line drum 12 and a main, or tubing, drum 14, mounted on shafts 16 and 18, respectively in a frame 19. Shaft 16 is rotatively supported by a pair of bearings 20 and 22, and shaft is likewise supported by a pair of bearings 24 and 26. Shaft 16 has connected to on one end thereof a clutch 28, and shaft 18 has a clutch 30 connected to one end thereof and a clutch 32 connected to the other end thereof. Drum 12 has a brake flange and brake band 34 on one end and a brake flange and band 35 on the other end. Likewise, drum 14 has a brake flange and band 36 on one end and a brake flange and band 38 on the other end. These brake flanges and bands in combination provide friction braking by drawing the band tightly against the flange.

Drums 10 and 12 are commonly driven by a hydraulic motor 40 connected to a drive shaft 42, which is supported in frame 19 by means of bearings 44, 46, and 48. Shaft 42 has on one end thereof a sprocket 50 which drives a sprocket 52 on shaft 16 by means of a chain 54. Similarly, shaft 42 also has on the same end thereof another sprocket 56 which drives a sprocket 58 on shaft 18 by means of chain 60. The other end of shaft 42 has a sprocket 62 which drives a sprocket 64 on shaft 16 by means of chain 66. Further, shaft 16 also has on the same end as sprocket 64 another sprocket 68 which is coupled to a sprocket 70 on shaft 18 by means of a chain 72.

It should be understood that the construction of draw works thus described in illustrative only, and any other suitable draw works design may be used, provided that a hydraulic motor 40 is used. Hydraulic motor 40 may be of any suitable type, but preferably it is of the type having a vane impeller.

Hydraulic motor 40 is connected to a multi-position rotary disk valve 100 by means of an input line 102 connected to port A on valve 100 and an output line 104 connected to port B on valve 100, which together form a fluid flow circuit. Valve 100 is of the type described in Applicant's U.S. Pat. No. 4,448,215, issued May 15, 1984, the description of which valve therein is incorporated herein by reference. Line 104 has connected therein a variable flow constrictor 106 which is bypassed by a check valve 108. Also tapped into line 104 is a bypass valve 110 through a main line 112 and a pilot line 114. Valve 110 has a movable control section 118 which is held in the "off" position by a variable tension spring 120.

Valve 100 is constructed in several sections. The main section 124 is a five position flow control valve as described in the above-referenced patent. Section 124 is integrally connected to a directional control disk 126 as illustrated by line 125. Directional control disk 126 is integrally connected to an output flow control disk 128 as illustrated by lines 130 and 132, which is itself connected to line 102 and 104. Line 102 communicates directly with line 130, and line 104 communicates directly with line 132 inside valve 100. It should be understood that lines 125, 130, and 132 are illustrative only and the connections represented thereby are all made internally to valve 100. Disks 126 and 128 are constructed in accordance with the principles described in the aforementioned U.S. Pat. No. 4,448,215. All disk sections in valve 100 may be rotated to provide different levels and types of flow control by means of a pneumatic actuator and associated logic unit (not shown).

Main valve section 124 is connected to three pumps 140, 142, and 144, by means of lines 146, 148, and 150. Each of pumps 140–142 have different capacities, 140 being the largest, 142 being the next smallest, and 144 being the smallest, as illustrated. Each of pumps 140–142 are connected by means of lines 152, 154, and 156, respectively, to a hydraulic fluid reservoir, or tank, 158.

Output control section 128 is connected by means of a line 170 to a high volume, low pressure pump 172, which is connected to hydraulic fluid reservoir 158 by means of a line 174. Output control section 128 is also connected by means of line 176 to a heat exchanger 178, which is itself connected to hydraulic fluid reservoir 158 by means of a line 180. Line 176 is also connected to flow control section 124 through a bypass line 182 and to bypass valve 110 through a line 184.

Pumps 140, 142, 144, and 172 are illustrated as separate pumps. It should be understood, however, that a part or all of these pumps may be implemented in a single multiplex pump as is commonly used in the drilling industry.

In operation, pumps 140–144 draw hydraulic fluid from tank 158 through lines 152–156, respectively, and supply it to flow control section 124 of valve 100 through lines 146–150, respectively. Valve 124 combines the fluid flows provided by pumps 140–144 in various combinations as selected by the driller or other operator. In a flow control section of the type described, five such combinations are available, and they are selected in such a way as to provide a regular progression of flow rates as a selector (not shown) is moved through its various positions by the operator. The portion of the total flow from pumps 140–144 not selected for use is bypassed back to fluid tank 158 through lines 180 and 182 and heat exchanger 178, which removes heat produced as a result of pump and system inefficiencies. These various flow combinations are best illustrated by means of the examples in the following table:

| Selector Position | Combination Selected | Returned to Tank |
|---|---|---|
| 1 | 140 | 142 + 144 |
| 2 | 142 | 140 + 144 |
| 3 | 144 | 140 + 142 |
| 4 | 140 + 142 | 144 |

-continued

| Selector Position | Combination Selected | Returned to Tank |
|---|---|---|
| 5 | 140 + 142 + 144 | — |

Although other combinations are obviously available and could be used, they are not necessary in most applications.

The fluid combination thus selected passes through internal line 125 to directional control disk 126, which has three positions (not illustrated) controllable by the operator. In the forward position fluid emanates from port A in valve 100, for example, and returns through port B. In the reverse position fluid emanates from port B and returns through port A. Finally, in the neutral position all fluid flow is returned to tank 158. It should be understood that "forward" and "reverse" are relative terms and depend upon the order of connection of lines 102 and 104 to hydraulic motor 104.

The fluid combination thus passes through internal lines 130 and 132 in a direction determined by directional control section 126 to an output control section 128, which simply selects either the flow from section 126 alone or the combination of the flow from section 126 and the flow from pump 172. If the flow from pump 172 is not selected, that portion of the total flow through section 128 is diverted back to supply tank 158 through lines 176 and 180 and heat exchanger 178.

When the fluid flow in lines 102 and 104 is in the "forward" direction and output valve section 128 is open, the flow drives hydraulic motor 40 in a manner to drive drums 10 and/or 12 to take up the cable supporting the drill string and thus raise the drill string from the borehole. To do this, the clutches 28, 30, and 32 are engaged as necessary by the operator in a manner well-known in the art.

When the operator decides to lower the drill string into the borehole, he releases clutches 28, 30, and 32, which permits the drill string to fall into the borehole by the action of gravity. During this time drums 10 and/or 12 freely rotate in the reverse direction. At an appropriate time during the fall determined by the driller as based upon his experience, the clutches 28, 30, and 32 are re-engaged as appropriate, which reconnects the reverse spinning drums 10 and/or 12 to hydraulic motor 40 through chains 54, 60, and 72, and shaft 42. This causes motor 12 to spin in the "reverse" direction in the fluid filling it, which dampens the drill string fall in the same manner as a water brake.

In normal circumstances the spinning of hydraulic motor 12 in the hydraulic fluid causes a pressure drop in the motor sufficient to cause cavitation, which is a series of microscopic explosions that are destructive to the motor 12. To forestall cavitation valve 126 is reversed to supply the maximum combination of fluid flows from pumps 140–144 to motor 12 in the reverse direction from port B as previously described. In addition, valve 128 is positioned so that the additional flow from pump 174 is added to the reverse flow to hydraulic motor 40. In this manner the low pressure caused by reverse rotation of hydraulic motor 40 is countered by the reverse pressure provided by pumps 140–144 and 172, thereby eliminating the conditions which lead to cavitation.

Regardless of the direction of fluid flow determined by the position of the disk valve in output control section 128, if the fluid pressure sensed by bypass valve 110 via pilot tube 114 exceeds a preset value determined by the stiffness of spring 120, movable valve section 118 is forced into registry with lines 116 and 184. This causes the excess fluid to be bypassed back to tank 158 via lines 184, 176, and 180 through heat exchanger 178.

While the present invention has been shown and described in a particular embodiment suitable for application to draw works for use in drilling, it should be obvious that minor changes and modifications may be made therein to produce other embodiments within the true scope and spirit of the invention for use both in the particularly described application and for other applications. It is the intention in the foregoing description and in the appended claims to cover all such other embodiments, and the language used in such description and claims should be read broadly to fulfill such intention.

What is claimed is:

1. In a draw works for use in raising and lowering a string of drill pipe in a borehole, a hydraulic motor for driving the draw works to raise the drill string; means for supplying a first stream of hydraulic fluid from the source to drive the motor; means for permitting said drill string to freely fall into the borehole under the influence of gravity when lowering of said drill string is desired; means for reversing the direction of flow of the first stream of hydraulic fluid; and means for supplying a second stream of hydraulic fluid to said motor when the flow of fluid to said motor is reversed; whereby said flow reversal combined with said second stream of fluid acts to brake said draw works when said string of drill pipe is freely falling into the borehole and to prevent cavitation in said motor.

2. In a draw works as described in claim 1 wherein said means for supplying a second stream of hydraulic fluid comprises a pump and a rotary disk valve section.

3. In a draw works as described in claim 2 wherein said reversing means comprises a second rotary disk valve section.

4. In a draw works as described in claim 3 wherein said means for supplying a first stream of hydraulic fluid is variable.

5. In a draw works as described in claim 4 wherein said variable means for supplying a stream of hydraulic fluid comprises a multiplicity of sources of fluid flows and means for combining said flows in various combinations and bypassing the portion of said flows not selected.

6. In a draw works as described in claim 5 wherein said multiplicity of sources provide fluid flows at different rates.

7. In a draw works as described in claim 6 wherein said combining and bypassing means comprises a third rotary disk valve section.

8. In a draw works as described in claim 7 wherein said multiplicity of sources comprises multiplex pump.

9. In a draw works as described in claim 8 wherein said hydraulic motor is of the vane type.

10. In a draw works as described in claim 9 wherein said first, second, and third rotary disk valve sections are combined in a single multi-section rotary disk valve.

11. A hydraulic draw works system for raising and lowering a drill string in a borehole, comprising a draw works having a cable take-up drum; a hydraulic motor operatively connected to the take-up drum; a multiplicity of pumps in fluid communication with the hydraulic motor; a rotary disk valve between said motor and the multiplicity of pumps; said valve including a first section for combining the flows from a first group of said pumps in a variety of combinations to drive said motor at different speeds, a second section for controlling the direction of flows of the combination of flows to said motor, and a third section for combining said combination of flows with the flows from a second group of said pumps; whereby the direction of fluid flow may be reversed and additional fluid may be provided during such reversal when said drill string is lowered into the borehole to thereby provide a fluid braking action while preventing cavitation in said motor.

12. A hydraulic draw works system as described in claim 11 wherein each of said first group of pumps operates at different flow rates, whereby said combination of flow rates may be varied in different increments.

13. A hydraulic draw works system as described in claim 12 wherein said first groups of pumps is combined into a single multiplex pump.

14. Method of lowering a string of drill pipe into a borehole using a draw works whose drum is driven by a hydraulic motor whose speed is controlled by a rotary disk valve, comprising the steps of: (a) disengaging the draw works clutch, thereby permitting the string to enter the borehole the action of gravity and causing the drum on the draw works to freewheel in the reverse direction; (b) reversing the flow of hydraulic fluid to the motor using the disk valve; (c) simultaneously with step (b), engaging the draw works clutch, (d) simultaneously with steps (b) and (c), directing an auxiliary stream of hydraulic fluid to said motor in the reverse direction using said disk valve; whereby steps (b), (c), and (d) act to brake the draw works and to prevent cavitation in said motor.

15. Method of providing a braking force to a string of drill pipe as it is lowered into a borehole using a draw works whose drum is driven through a clutch by a hydraulic motor whose speed is controlled by a rotary disk valve, comprising the steps of: (a) reversing the flow of hydraulic fluid to the motor using the disk valve; (b) simultaneously with step (a), engaging the draw works clutch, thereby causing said motor to rotate in the reverse direction in said hydraulic fluid, (c) simultaneously with steps (a) and (b), directing an auxiliary stream of hydraulic fluid to said motor in the reverse direction using said disk valve; whereby said steps (a) and (c) act to damp the reverse rotating motor works and to prevent cavitation in said motor.

* * * * *